United States Patent [19]

Crosser et al.

[11] Patent Number: 5,025,626

[45] Date of Patent: Jun. 25, 1991

[54] CUSHIONED SWING CIRCUIT

[75] Inventors: Jeffery A. Crosser, Joliet; Randall L. Mooberry, East Peoria; James D. Rinaldo, Joliet; José M. Salazar-Vior, Washington, all of Ill.

[73] Assignee: Caterpillar Inc., Peoria, Ill.

[21] Appl. No.: 401,392

[22] Filed: Aug. 31, 1989

[51] Int. Cl.[5] ..... F16D 57/06

[52] U.S. Cl. ..... 60/460; 60/450; 60/466; 60/468

[58] Field of Search ..... 60/459, 460, 450, 466, 60/468, 494; 212/149, 153, 162; 414/744.1, 744.2

[56] References Cited

U.S. PATENT DOCUMENTS

| | | | |
|---|---|---|---|
| 3,246,471 | 4/1966 | Goodale | 60/450 X |
| 3,490,606 | 1/1970 | Gordon | 212/66 |
| 3,747,350 | 7/1973 | West et al. | 60/459 |
| 3,999,386 | 12/1976 | Crull et al. | 60/468 X |
| 4,132,506 | 1/1979 | Dantlgraber | 60/450 X |
| 4,194,365 | 3/1980 | Stoufflet et al. | 60/468 |
| 4,382,485 | 5/1983 | Kirkham | 60/450 X |
| 4,520,625 | 6/1985 | Sato et al. | 60/494 X |
| 4,586,332 | 5/1986 | Schexnayder | 60/494 X |
| 4,628,690 | 12/1986 | Arai et al. | 60/468 X |
| 4,694,649 | 9/1987 | Howeth | 60/468 |
| 4,738,330 | 4/1988 | Suzuki et al. | 60/450 X |
| 4,782,662 | 11/1988 | Reeves et al. | 60/327 |

FOREIGN PATENT DOCUMENTS

| | | | |
|---|---|---|---|
| 54-69676 | 6/1979 | Japan | 60/468 |

*Primary Examiner*—John T. Kwon
*Assistant Examiner*—John Ryznic
*Attorney, Agent, or Firm*—John W. Grant

[57] ABSTRACT

Cushioned swing circuits sometimes have a restricted passage between the motor conduits to allow the implement controlled by the swing circuit to coast to a stop. However, opening and closing of the restricted passage was manually controlled, thereby requiring an additional manipulative step by the operator. The present cushioned swing circuit includes a cushion valve moveable to an open position to establish communication through vent line means when a pressure differential greater than a predetermined level is generated in one of the motor conduits connecting a directional control valve to a hydraulic motor. The cushion valve is retained in the open position for a predetermined limited time after the pressure differential drops below the predetermined level so that the inertia generated pressure in the circuit is dissipated through the vent line means. At the end of the predetermined limited time, the cushion valve is moved to the closed position blocking communication through the vent line means whereupon the circuit is hydraulically locked. The cushion valve is moved between the opened and closed positions automatically and requires no additional effort by the operator.

14 Claims, 1 Drawing Sheet

CUSHIONED SWING CIRCUIT

DESCRIPTION

1. Technical Field

This invention relates generally to a swing circuit for controlling the swinging movement of a boom for a backhoe or excavator and more particularly to a means for dissipating the inertial energy in the circuit when movement of the boom is suddenly stopped.

2. Background Art

The position of a boom of a backhoe is commonly controlled by a pair of bi-directional hydraulic cylinders or motors connected between a main support frame and a boom support frame. The boom is swung in an arcuate path about its pivotal connection to the main frame generally by extending one of the motors and retracting the other motor. The boom control circuit is normally provided with a pair of line relief valves and a pair of make-up valves connected to the respective conduits connecting the control valve to the hydraulic motors. The line relief valves function to vent fluid from one of the conduits when excessive pressure is generated therein while the make-up valves function to provide make-up fluid to a conduit if it becomes cavitated.

One of the problems sometimes encountered therewith occurs when the swinging motion of the boom is abruptly stopped by moving the directional control valve to its neutral position and the inertial energy of the boom and an implement supported thereby generates fluid pressure in one of the conduits sufficient to open the relief valve thereby allowing fluid to be expelled from that conduit. This results in the other conduit being cavitated. While the make-up valves direct most of the expelled fluid into the cavitated conduit some of the expelled fluid leaks past other valves in the system and not all of the expelled fluid is reclaimed such that a void is created on one side of the hydraulic motor. This void then allows the boom to rebound or bounce from side to side a small amount until the inertia energy is dissipated. This is a performance deficiency sometimes referred to as "boom wag". One approach to solving a similar boom wag problem in hydraulic excavators is to interconnect the conduits through an orificed passage so that the high pressure fluid generated in the one conduit by the inertia of the boom is transmitted directly to the other conduit. However, heretofore the orificed passage was either open all the time or it had to be blocked by the operator manually initiating the closing of a valve. If the orificed passage is open at all times, then the boom can drift if the backhoe is being operated on a side slope. If a manual actuated valve is employed, then the operator has an additional function to perform.

The present invention is directed to overcoming one or more of the problems as set forth above.

DISCLOSURE OF THE INVENTION

In one aspect of the present invention a cushioned swing circuit comprises a bi-directional hydraulic motor, a directional control valve, first and second motor conduits individually connected to the directional control valve and to the opposite ends of the motor, vent line means connected to one of the first and second motor conduits, and a cushion valve connected to the vent line means and moveable between a closed position blocking fluid flow through the vent line means and an open position establishing fluid flow through the vent line means. The cushion valve includes spring means for resiliently biasing the cushion valve to the closed position. A means is provided for restricting fluid flow through the vent line means when the valve is in the open position. A flow restriction means disposed in one of the first and second motor conduits generates a pressure differential in the fluid therein when fluid is flowing therethrough. A means is provided for moving the cushion valve to the open position when the pressure differntial exceeds a predetermined level. A means is provided for maintaining the cushion valve in the open position for a predetermined limited time after the pressure differential drops below the preselected level.

The present invention provides a cushioned swing circuit which has a cushion valve for controlling the communication of fluid through a vent line means connected to a first motor conduit. The cushion valve is normally closed and is opened when a pressure differential above a predetermined level is generated in the second motor conduit by a flow restriction means disposed in the second motor conduit. Thus, when the directional control valve is moved to a neutral fluid blocking position, the pressure generated in the first motor conduit by the inertial energy of the implement is dissipated through the vent line means. The fluid flow through the vent line means is restricted. In two embodiments, the vent line means is connected to the second conduit so that the inertia generated pressurized fluid expelled from the first motor conduit is transmitted directly to the second motor conduit. In a third embodiment, the pressurized fluid passes through the vent line means to a tank. The cushion valve is retained in the open position for a predetermined limited time after the pressure differential drops below the predetermined level. Such period of time is selected so that by the time the boom comes to a stop, the cushion valve will have moved to a closed position so that the boom is then hydraulically locked in the desired position. Thus, opening and closing of the cushion valve is automatic and does not require an additional function for the operator to perform.

BEST MODE FOR CARRYING OUT THE INVENTION

Figure 1:
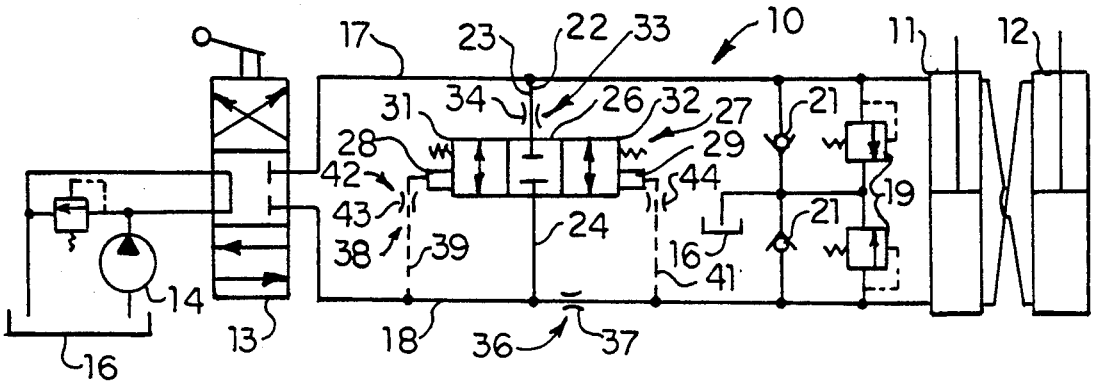
FIGS. 1, 2, and 3 are schematic representations of embodiments of the present invention.

Referring now to FIG. 1, a first embodiment of a cushioned swing circuit 10 controls fluid flow to and from a pair of bi-directional hydraulic motors 11,12. The hydraulic motors of this embodiment are utilized for controlling the swinging motion of a rotatable mechanism such as a boom (not shown) of a backhoe and have their opposite ends suitably interconnected such that as the hydraulic motor 11 extends, the hydraulic motor 12 retracts and vice-versa. A directional control valve 13 is connected to a pump 14 and to a tank 16 in the usual manner. First and second motor conduits 17,18 are individually connected to the directional control valve 13 and to the opposite ends of the hydraulic motor 11. A pair of line relief valves 19 and a pair of make-up valves 21 are suitably connected to the first and second motor conduit 17,18 and to the tank 16 in the usual manner.

The directional control valve 13 is moveable between a neutral closed position as shown and first and second operating positions. In the closed position, the first and second motor conduits 17,18 are blocked from each other and from the pump 14 and the tank 16. Upward movement of the directional control valve 13, as viewed in the drawing, to the first operating position establishes communication between the pump 14 and the second motor conduit 18 and between the first motor conduit 17 and the tank 16. Conversely, moving the directional control valve downwardly to the second operating position establishes communication between the pump 14 and the first motor conduit 17 and between the second conduit 18 and the tank 16.

A vent line means 22 has a first section 23 connected to the first motor conduit 17 and a second section 24 connected to the second motor conduit 18. A cushion valve 26 is disposed between and connected to the first and second sections 23,24 of the vent line means 22. The cushion valve is a three-position valve and is shown in a centered closed position blocking fluid flow through the vent line means 22. The cushion valve is moveable either leftwardly or rightwardly from the closed position to open positions establishing fluid flow through the vent line means. The cushion valve includes spring means 27 for resilient biasing the valve to the centered closed position. The cushion valve 26 has a pair of actuating chambers 28,29 disposed at opposite ends 31,32 thereof.

A means 33 is provided for restricting fluid flow through the vent line means 22 when the cushion valve 26 is in the open position. The means 33 in this embodiment is an orifice 34 disposed in the first section 23 of the vent line means 22. Alternatively, the orifice 34 can be positioned in the second section 24 of the vent line means 22 or internally within the cushion valve 26.

A flow restriction means 36 is disposed in the second motor conduit 18 for generating a pressure differential in the fluid in the second motor conduit when fluid is flowing therethrough. The flow restriction means 36 can be, for example, an orifice 37 disposed in the second motor conduit 18.

A means 38 is provided for moving the cushion valve 26 to the appropriate open position when the pressure differential in the fluid in the second conduit 18 exceeds a predetermined level. The moving means 38 includes a pair of pilot passages 39,41 connected to the actuating chambers 28,29, respectively. The pilot passage 39 is connected to the second motor conduit 18 between the directional control valve and the orifice 37. The pilot passage 41 is connected to the second motor conduit between the motor 11 and the orifice 37.

A means 42 is provided for retaining the cushion valve 26 in the open position for a predetermined limited time after the pressure differential drops below the preselected level. The means 42 includes a pair of orifices 43,44 disposed in the pilot passages 39,41, respectively.

Figure 2:
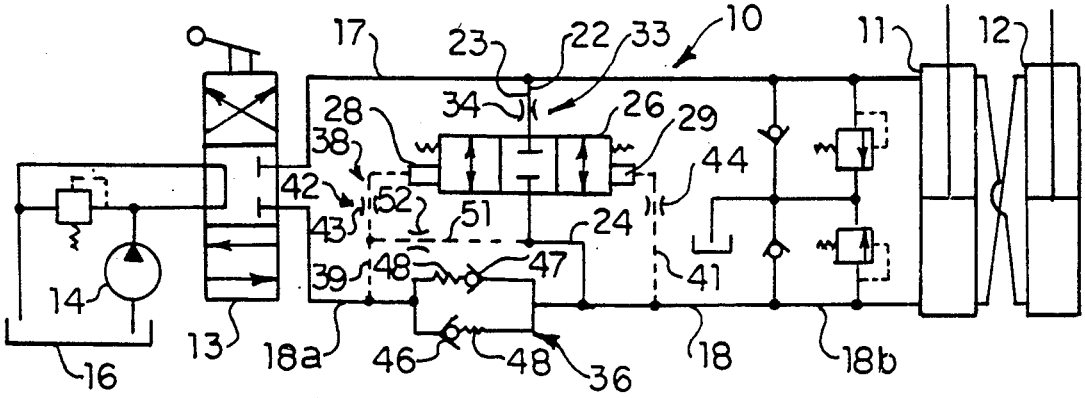

A second embodiment of the cushion swing circuit 10 of the present invention is disclosed in FIG. 2. It is noted that the same reference numerals of the first embodiment are used to designate similarly constructed counterpart elements of this embodiment. In this embodiment, however, the flow restriction means 36 includes a pair of check valves 46,47 arranged in parallel flow relationship between sections **18*a*,18*b* of the second motor conduit 18. Each of the check valves 46,47 includes a spring 48 which resiliently biases the respective check valve to the closed position. The spring 48 establishes a pressure differential in the motor conduit 18 at which the check valves open to permit flow therethrough. In this embodiment, the pressure differential established by the check valves is substantially equivalent to the predetermined level necessary for moving the cushion valve 26** to the open position.

Also in this embodiment a pilot vent passage 51 interconnects the pilot passage 39 with the second portion 24 of the vent line means 22 through an orifice 52. The orifice 52 is slightly larger than the orifice 43.

Figure 3:
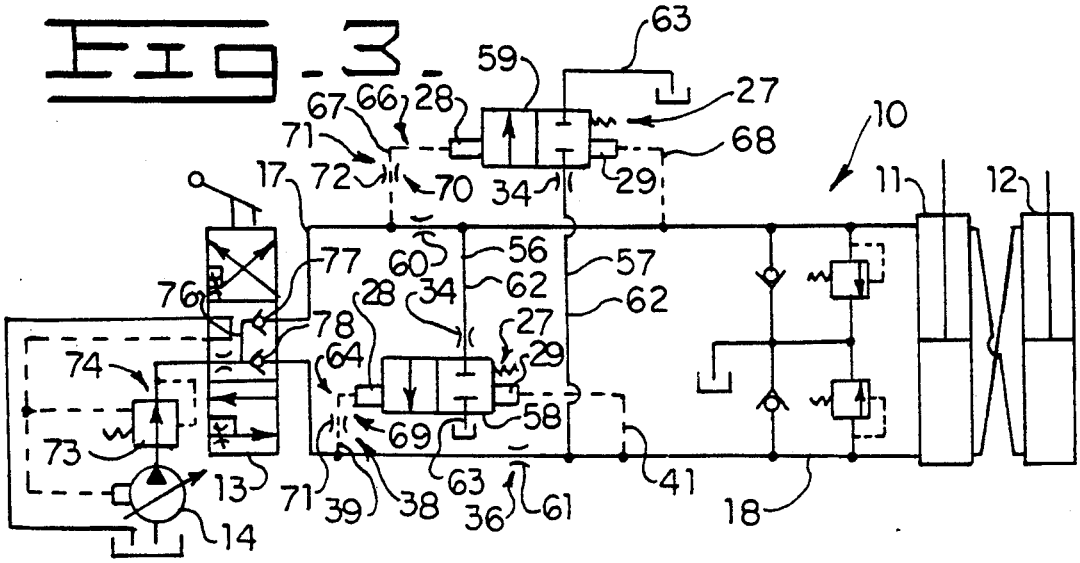

A third embodiment of the cushioned swing circuit 10 of the present invention is disclosed in FIG. 3. It is noted that the same reference numerals of the first and second embodiments are used to designate similarly constructed counterpart elements of this embodiment. This embodiment, however, includes a pair of vent line means 56,57 and a pair of cushion valves 58,59 with the flow restriction means 36 including a pair of orifices 60,61 individually disposed in the first and second motor conduits 17,18. The vent line means 56 has a first section 62 connected to the first motor conduit 17 and a second section 63 connected to the tank 16. Similarly, the second vent line means 57 has a first section 62 connected to the second motor conduit 18 and a second section 63 connected to the tank 17. Each of the first sections 62 has an orifice 34 therein.

The cushion valve 58 is disposed between and connected to the first and second sections 62,63 of the vent line means 56. Similarly, the cushion valve 59 is disposed between and connected to the first and second sections 62,63 of the vent line means 57. Each of the cushion valves 58,59 is a two-position valve and is moveable between a closed position as shown in the drawing and an open position. Each of the cushion valves 58,59 include spring means 27 for resiliently biasing it to the closed position and a pair of actuating chambers 28,29 at opposite ends thereof. Moreover, this embodiment includes a means 64 for moving the cushion valve 58 to the open position when a pressure differential exceeding a predetermined level is generated in the second motor conduit 18 when fluid is flowing therethrough from the directional control valve 13 to the motors 11,12 and a means 66 for moving the cushion valve 59 to the open position when a pressure differential exceeding a predetermined level is generated in the first motor conduit 17 when fluid is flowing therethrough from the directional control valve 18 to the motors 11,12. The moving means 64 includes a pilot passage 39 connected to the actuating chamber 28 of the cushion valve 58 and to the second motor conduit 18 between the directional control valve and the orifice 61 and a pilot passage 41 connected to the actuating chamber 29 of the cushion valve 58 and to the second motor conduit 18 between the orifice 61 and the hydraulic motor 11. Similarly, the moving means 66 includes a pilot passage 67 connected to the actuating chamber 28 of the cushion valve 59 and to the first motor conduit 17 between the directional control valve 13 and the orifice 60 and a pilot passage 68 connected to the actuating chamber 29 of the cushion valve 59 and the first motor conduit 17 between the orifice 60 and the hydraulic motor 11. A means 69 for retaining the cushion valve 58 in the open position for a predetermined limited time after the pressure differential drops below the predetermined level includes an orifice 71 disposed in the pilot passage 39. Similarly, a means 70 for retaining the cushion valve 59 in the open position for a predetermined limited time after the pressure differential in the first motor conduit 17 drops below the predetermined level includes an orifice 72 disposed in the third pilot passage 67.

The pump 14 of the third embodiment is a variable displacement load sensing pump and supplies fluid to the directional control valve 13 of the cushioned swing circuit 10 through a pressure compensated flow control valve 73. The pressure compensated flow control valve 73 serves to maintain the pressure of the fluid delivered to the directional control valve 18 above a predetermined minimum pressure. The cushioned swing circuit 10 includes a replenishing means 74 for providing make-up the fluid to the first and second motor conduits 17,18 when a negative pressure exists therein. The replenishing means 74 includes an orificed passage 76 in the directional control valve with the orificed passage being connected to the first and second motor conduits 17,18 through a pair of check valves 77,78.

Alternatively, the pump 14 of the first and second embodiments may also be a variable displacement load sensing pump. The predetermined level of the pressure differential can be, for example, in the range of from about 415 kPa to about 485 kPa.

Industrial Applicability

In the use of the present invention, simultaneous extension of the hydraulic motor 11 and retraction of the hydraulic motor 12 is initiated by the operator shifting the directional control valve 13 upwardly to the first operating position for directing pressurized fluid from the pump 14 into the second motor conduit 18 and communicating the first motor conduit 17 with the tank 16. As the fluid passes through the orifice 37, a pressure differential is generated in the second motor conduit 18 with the fluid pressure upstream of the orifice 37 being greater than the pressure downstream of the orifice. The upstream pressure is transmitted through the pilot passage 39 and the orifice 43 into the actuating chamber 28 while the downstream pressure is transmitted through the pilot passage 41 and the orifice 44 into the actuating chamber 29. The pressure drop across the orifice 37 is responsive to the flow rate through the second motor conduit 18 and once the pressure differential exceeds a predetermined level, the higher pressure in the actuating chamber 28 moves the cushion valve 26 to the right to the open position to establish fluid flow through the vent line means 23. While some of the pressurized fluid in the second motor conduit 18 passes through the vent line means 22 to the first motor conduit 17, the orifice 34 significantly restricts such flow so that it has little effect on the operation of the circuit. The cushion valve 26 will remain in the open position as described so long as sufficient fluid flow is passing through the orifice 37 to maintain the pressure differential above the predetermined level.

To stop the swinging motion of the mechanism controlled by the hydraulic motors 11,12, the operator returns the directional control valve 13 to the neutral position shown. This immediately blocks the pump 13 from the second motor conduit 18 and the first motor conduit 17 from the tank 16. However, the inertia energy of the mechanism will now cause inertia induced pressurized fluid to be expelled from the hydraulic motors and into the first conduit 17. The expelled fluid passes through the vent line means 22 and the orifice 34 therein, the cushion valve 26 and through the second motor conduit 18 into the motors 11,12 to dissipate the inertia generated fluid pressure and maintain the motors filled with fluid. The orifice 34 restricts the fluid flow through the vent line means 22 and is sized to cause the hydraulic motors 11,12 to controllably coast to a stop. Simultaneously, with the above event, the stoppage of fluid flow through the second motor conduit 18 and the orifice 37 causes the pressure differential in the second motor conduit 18 to drop below the predetermined level thereby allowing the spring means 27 to start moving the cushion valve 26 toward the closed position. However, the orifice 43 restricts the flow of fluid being expelled from the actuating chamber 28 and thereby retains the cushion valve 26 in the open position for a predetermined limited time. The size of the orifice 43 is selected so that the predetermined limited time substantially coincides with the average time it takes the hydraulic motors 11,12 to coast to a stop. The cushion valve will reach its closed position at the end of the predetermined limited time so that the hydraulic motors are then hydraulically locked at the desired location.

Reverse motion of the hydraulic motors 11,12 is initiated by the operator moving the directional control valve 13 downwardly to the second operating position. This causes pressurized fluid from the pump 14 to cause retraction of the hydraulic motor 11 and extension of the hydraulic motor 12. The fluid expelled from the hydraulic motors passes through the second motor conduit 18, the orifice 37, and the directional control valve 13 to the tank 16. The flow of fluid through the orifice 37 generates a pressure differential in the fluid upstream and downstream thereof with the higher pressure fluid upstream thereof being directed through the pilot passage 41 and into the actuating chamber 29 while the downstream pressure is transmitted through the pilot passage 39 and into the actuating chamber 28. Thus, when pressure differential exceeds the predetermined level, the cushion valve is moved to the left against the bias of the spring means 27 to the open position to establish communication through the vent line means 22. Thus, similarly to that described above, when the directional control valve 13 is moved to the centered blocking position to stop movement of the hydraulic motors 11,12, the cushion valve 26 is already open so that the fluid expelled from the hydraulic motors due to the inertia energy in the mechanism passes through the vent line means 22 and into the other end of the hydraulic motors. The cushion valve 26 will remain in the open position for the predetermined limited time thereby allowing the hydraulic motors to controllably coast to a stop as dictated by the orifice 44.

The operation of the embodiment of FIG. 2 is essentially the same as described above with the difference being the way the pressure differential in the second motor conduit 18 is generated. With the second embodiment, the pressure differential is generated by the flow of fluid through the appropriate one of the check valves 46,47 depending upon which direction the fluid is flowing. For example, when the fluid is flowing from the directional control valve 13 to the hydraulic motors 11,12 through the motor conduit 18, the fluid passes through the check valve 46 such that the fluid pressure in the first section 18*a* will be higher than the fluid pressure in the second section 18*b*. The spring 49 of check valve 46 establishes the pressure differential at a predetermined level which is sufficient to cause the cushion valve 26 to move rightwardly to the first open position thereby establishing fluid communication through the vent line means 22. Similarly, when fluid is flowing through the second motor conduit 18 from the motors 11,12 to the direction a control valve 13, the fluid passes through the check valve 47 such that the fluid pressure in the second section 18*b* will be higher than the fluid pressure in the first second 18*a*. The pressure differential in the motor conduit 18 will be established at a predetermined level by the spring 48 of the check valve 47 and will be sufficient to cause the cushion valve 26 to move leftwardly to the second open position. As described above, the respective orifices 43,44 will cause the cushion valve 26 to remain in the open position for a predetermined limited time after the fluid flow through the check valves has stopped and the pressure differential drops below the predetermined level so that the hydraulic motors controllably coast to a stop when the directional control valve 13 is moved from an operating position to a blocking position.

In the use of the embodiment of FIG. 3, when the directional control valve 13 is moved upwardly to the first operating position for directing fluid through the second motor conduit 18 to the hydraulic motors 11,12, the fluid flow through the orifice 61 generates a pressure differential in the second motor conduit 18. The higher fluid pressure upstream of the orifice 61 is transmitted through the pilot passage 39 to the actuating chamber 28 of the cushion valve 58 while the lower downstream pressure is transmitted through the pilot passage 41 to the actuating chamber 29. When the pressure differential exceeds the predetermined level, the cushion valve 59 is moved rightwardly to the open position to establish communication through the vent line means 56. Thus, when the directional control valve 13 is moved to the neutral closed position, the inertia generated fluid pressure in the first motor conduit 17 is dissipated through the vent line means 56 and the open cushion valve 58 to the tank 16. Simultaneous therewith, the fluid replenishing system 74 directs pressurized fluid through the orificed passage 76 and the check valve 78 in the directional control valve 13 and into the motor conduit 18 to prevent cavitation from occurring in the hydraulic motors 11,12. Similar to that described above, the orifice 71 will delay movement of the cushion valve 58 to the closed position for the predetermined limited time after the pressure differential drops below the predetermined level.

It should be noted that when the directional control valve 13 is in the first operating position described above, the fluid exhausted from the hydraulic motors 11,12 generates a pressure differential as it passes through the orifice 60 in the first motor conduit 17. However, since the higher pressure is transmitted through the pilot passage 68 and into the actuating chamber 29 of the cushion valve 59, the cushion valve 59 is thereby biased toward the closed position so that communication through the vent line means 57 remains blocked.

Moving the directional control valve 13 downwardly to the second operating position results in the cushion valve 59 being moved to the open position to establish communication through the vent line means 57 and the cushion valve 59 to the tank 16. Thus, when the directional control valve is moved back to the neutral closed position, the inertia generated pressure in the second motor conduit 18 is dissipated through the vent line means 57 similarly to that described above.

The present invention provides an improved cushioned swing circuit in which a cushion valve is automatically moved to an open position to establish communication through a vent line means during the normal operation of the hydraulic motors and prior to inertia induced pressure being generated in the circuit. Thus, when inertia induced pressure is generated in the circuit, the pressure is dissipated through the vent line means allowing the implement controlled by the hydraulic motor to controllably coast to a stop. Movement of the cushion valve back to its closed position is delayed for a predetermined limited time whereupon the cushion valve automatically moves to its closed position so that the hydraulic motors are then hydraulically locked in the desired position.

Other aspects, objects, and advantages of this invention can be obtained from a study of the drawings, the disclosure, and the appended claims.

We claim:

1. A cushioned swing circuit comprising:

a bi-directional hydraulic motor;

a directional control valve;

first and second conduits individually connected to the directional control valve and the hydraulic motor;

vent line means connected to at least one of the first and second motor conduits;

a cushion valve connected to the vent line means and moveable between a closed position blocking fluid flow through the vent line means and an open position establishing fluid flow through the vent line means, said cushion valve including spring means for resiliently biasing the cushion valve to the closed position;

means for restricting fluid flow through the vent line means when the cushion valve is in the open position;

flow restriction means disposed in one of the first and second motor conduits for generating a pressure differential therein when fluid is flowing therethrough;

means for moving the cushion valve to the open position position when the pressure differential exceeds a predetermined level; and means for retaining the cushion valve in the open position for a predetermined limited time after the pressure differential drops below the predetermined level.

2. The cushioned swing circuit of claim 1 wherein the vent line means is connected to the first motor conduit and the flow restriction means is disposed in the second motor conduit and generates said pressure differential therein when the fluid is flowing therethrough from the directional control valve to the hydraulic motor.

3. The cushioned swing circuit of claim 2 wherein the cushion valve has opposite ends and an actuating chamber at each of the ends, said moving means including a first pilot passage connected to one of the actuating chambers and to the second motor conduit between the directional control valve and the flow restriction means and a second pilot passage connected to the other of the actuating chambers and to the second motor conduit between the hydraulic motor and the flow restriction means.

4. The cushioned swing circuit of claim 3 wherein the retaining means includes an orifice in the first pilot passage.

5. The cushioned swing circuit of claim 4 wherein said flow restriction means includes an orifice disposed in the second motor conduit.

6. The cushioned swing circuit of claim 5 including a tank, said vent line means being in communication with the tank when the cushion valve is in the open position.

7. The cushioned swing circuit of claim 6 including replenishing means for providing make-up fluid to the second motor conduit when a negative pressure exists therein.

8. The cushioned swing circuit of claim 6 including another vent line means connected to the second motor conduit and to the tank, another cushion valve connected to the another vent line means, an orifice in the another vent line means, a third pilot passage connected to the first actuating chamber of the another cushion valve and to the first motor conduit between the directional control valve and the orifice, and a fourth pilot passage connected to the second actuating chamber of the another cushion valve and to the first motor conduit between the hydraulic motor and the orifice, and an orifice in the third pilot passage.

9. The cushioned swing circuit of claim 5 wherein the vent line means is connected to the second motor conduit and said cushion valve is moveable to another open position at which communication through the vent line means is established.

10. The cushioned swing circuit of claim 9 wherein said flow restriction means generates a second pressure differential in the second motor conduit when fluid is flowing therethrough from the hydraulic motor to the directional control valve, said cushion valve being moved to another open position when the second pressure differential exceeds said predetermined level.

11. The cushioned swing circuit of claim 4 wherein the flow restriction means includes a check valve disposed in the second motor conduit, said check valve being biased to a closed position by a spring.

12. The cushioned swing circuit of claim 11 wherein the vent line means is connected to the second motor conduit and said cushion valve is moveable to another open position at which communication through the vent line means is established.

13. The cushioned swing circuit of claim 12 wherein said flow restriction means generates a second pressure differential in the fluid in the second motor conduit when the fluid is flowing therethrough from the hydraulic motor to the directional control valve, said cushion valve being moved to the another open position when the second pressure differential exceeds a second predetermined level.

14. The cushioned swing circuit of claim 13 wherein said flow restriction means includes another check valve arranged in parallel flow relationship to the first mentioned check valve, said another check valve being biased to a closed position by a spring.

* * * * *